United States Patent [19]

Landers

[11] Patent Number: 4,773,792

[45] Date of Patent: Sep. 27, 1988

[54] SYSTEM FOR STABILIZING STRUCTURAL ELEMENTS

[76] Inventor: Phillip G. Landers, 518 Santander Dr., San Ramon, Calif. 94583

[21] Appl. No.: 75,577

[22] Filed: Jul. 20, 1987

[51] Int. Cl.[4] ..... E02D 5/00

[52] U.S. Cl. ..... 405/230; 405/229; 405/288; 405/289

[58] Field of Search ..... 405/229, 233, 289, 288, 405/146, 290, 230, 303

[56] References Cited

U.S. PATENT DOCUMENTS

| | | | |
|---|---|---|---|
| 3,396,545 | 8/1968 | Lamberton | 405/233 |
| 3,492,823 | 2/1970 | Lamberton | 405/233 |
| 4,092,296 | 5/1978 | Skiff . | |
| 4,120,164 | 10/1978 | Tomlin | 405/289 |
| 4,277,204 | 7/1981 | Koppers et al. | 405/288 |
| 4,465,405 | 8/1984 | Durrfeld | 405/289 |

*Primary Examiner*—Dennis L. Taylor

*Attorney, Agent, or Firm*—Glen R. Grunewald; Thomas R. Lampe

[57] ABSTRACT

A system for stabilizing a first structural element relative to a second structural element wherein a flexible container containing a foaming agent is positioned between the structural elements, the agent is expanded within the container and partially migrates from the container to form a bond with at least one of the structural elements, and the agent is hardened in place.

19 Claims, 2 Drawing Sheets

SYSTEM FOR STABILIZING STRUCTURAL ELEMENTS

TECHNICAL FIELD

This invention relates to a system for stabilizing spaced structural elements so that the elements maintain a fixed position relative to one another.

The system has particular application to load bearing structural elements. Examples are underground utility enclosures and associated cover frames, as well as other ground or pad mounted equipment and structures.

BACKGROUND ART

The most common approach for stabilizing structural load bearing elements such as underground enclosures and their associated frames is to employ cementous grout. Even when quick setting cementous grout is employed for such purpose, a tremendous investment in labor and time is involved. For example, installation of quick setting cementous grout between an underground utility vault and its frame quite typically runs in the order of 4 to 6 hours. Then too, there is an extended set time before full traffic loads can be withstood. It is not uncommon for set time of quick setting cementous grout to run in the order of three days or more. Because of the long period of time between installation of cementous grout and load bearing set time, a crew will have to make a separate trip to the site to reopen the street or perform such other actions as may be necessary, again adding to the cost of the project.

Waste can also be a problem when cementous grout or other materials are mixed on site. In fact, loss is virtually bound to occur when typical techniques are employed to fill a void space between load bearing structural elements. Often too much grout or other similar material is mixed simply because it is difficult to estimate requirements. And, of course, when employing conventional approaches a good portion of the grout or other mixture regularly ends up where it is not required.

DISCLOSURE OF INVENTION

The present invention, by contrast, relates to a system for stabilizing load bearing structural elements quickly and efficiently. In fact, in most applications, the time from initial installation to full load bearing capacity will normally run one hour or so. Thus, when the present system is employed, labor time and costs are significantly reduced as compared to the prior art approach of utilizing cementous grout.

The present system also conserves materials by virtually eliminating waste. The amount of material to be employed can be estimated readily. In addition, spillage almost never occurs and the material is confined to where it is actually needed.

According to the teachings of the present invention, a semi-permeable, flexible container containing a structural foaming agent is positioned in a void space between two structural elements, for example, an underground enclosure and a frame spaced from the underground enclosure. The components of the structural foaming agent are mixed just prior to placement of the container in the void space. When the agent foams, it expands, filling the flexible container, and a portion of the agent migrates from the interior of the container to the outer surface thereof through a plurality of openings in the container.

The migrating agent portion from the one or more containers in the void space contacts the structural elements during foaming. When the foam is hardened in place, a bond will thus be established between the container (or the containers) in the void space and the structural elements whereby the structural elements are stabilized in position.

BEST MODE FOR CARRYING OUT THE INVENTION

Figure 5:
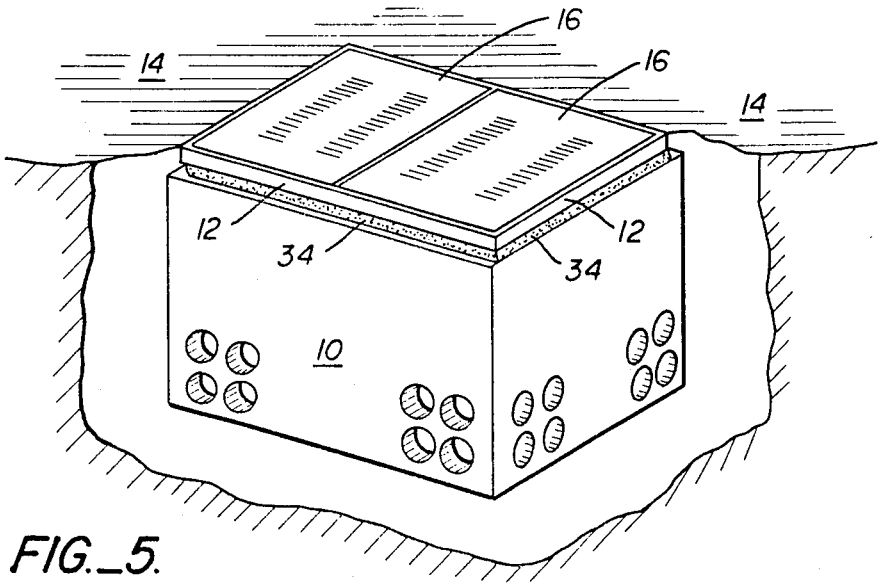
FIG. 5 is a perspective view of two structural elements having a plurality of containers filled with structural foaming agent positioned therebetween.
Figure 6:
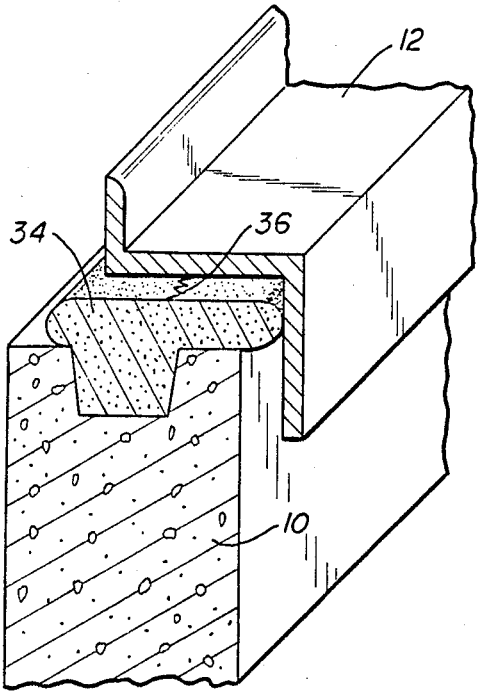
FIG. 6 is an enlarged, perspective, cross-sectional view illustrating portions of two structural elements and a container filled with foaming agent, prior to foaming, disposed therebetween.
Figure 7:
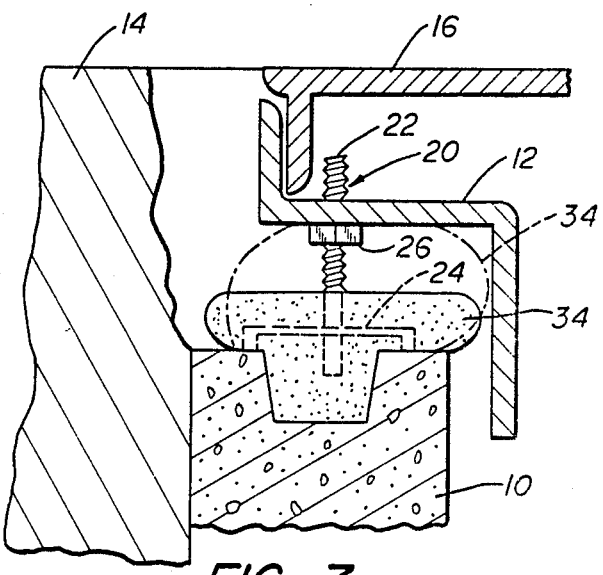
FIG. 7 is a cross-sectional end view of the structural elements and container illustrating how the configuration of the container changes during the foaming operation.

Referring now to the drawings, and in particular to FIGS. 5–7, a structural element in the form of an underground utility enclosure or vault 10 is illustrated. Disposed above enclosure 10, as is conventional, is a second load bearing structural element 12 in the form of a traffic frame. For purposes of illustration, elements 10 and 12 are positioned in a roadway 14 and traffic frame 12 carries lids 16 substantially coplanar with the roadway.

It will be appreciated that the system of the present invention is employed to stabilize traffic frame 12 relative to enclosure 10 in such a way as to transfer any load imparted to traffic frame 12 to the enclosure. Prior to carrying out the method of the present invention, the frame and enclosure must be relatively positioned so as to provide a void space therebetween. This may be done through use of any suitable conventional hardware such as the spacer shown in FIG. 7 and identified generally by reference numeral 20. Spacer 20 includes a rod 22 having screw threads formed thereon. Rod 22 is threadedly engaged with a bracket 24 positioned on enclosure 10 and a nut 26. Rod 22 projects through an aperture in traffic frame 12 so that the frame rests upon nut 26. It will be appreciated that the nut may be adjusted along the length of rod 22 to adjust the spacing between elements 10 and 12. Of course, a number of spacers 20 are suitable deployed along the periphery of elements 10 and 12 to provide substantially uniform spacing therebetween.

Figure 1:
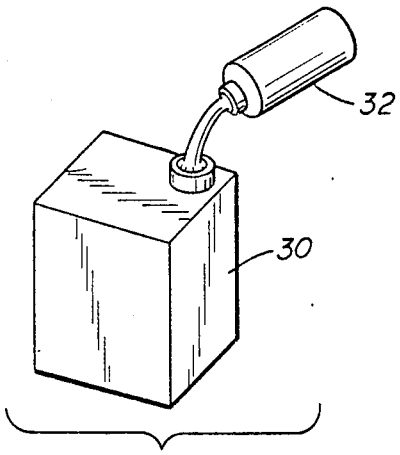
FIG. 1 is a somewhat schematic illustration of the step of combining the foaming agent components during the initial stage of the mixing procedure.

Referring now to FIG. 1, such Figure merely illustrates the fact that structural foaming agents of the type employed in the present invention are of a multi-component nature, said components being mixed to initiate the chemical processes involved in the foaming action. For purposes of illustration, the foaming agent is a two component system. One such system which has been found to be effective is a liquid epoxy foam system having a ceramic filler, such as the foam marketed by Insitu Corporation under the trademark "InsituFoam" and incorporating materials disclosed in U.S. Pat. No. 4,092,296. The epoxy resin associated with such system can be contained in receptical 30 and the curing agent contained in bottle 32. The operator pours the contents of bottle 32 into receptical 30 to complete the foam system. The system is then thoroughly mixed by any suitable expedient within receptical 30.

Figure 2:
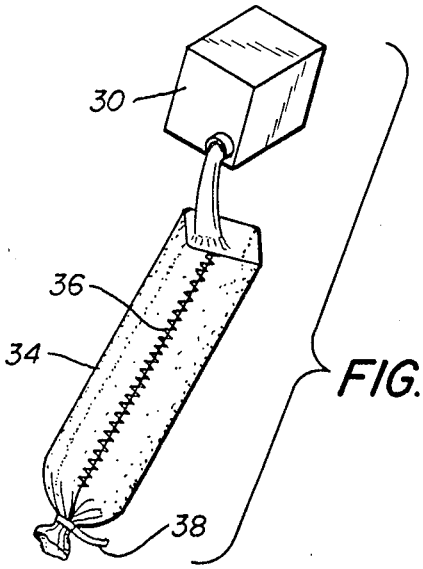
FIG. 2 is a perspective view, also in somewhat schematic fashion, showing the mixed foaming agent being poured into a container of a type employed in the present system.
Figure 3:
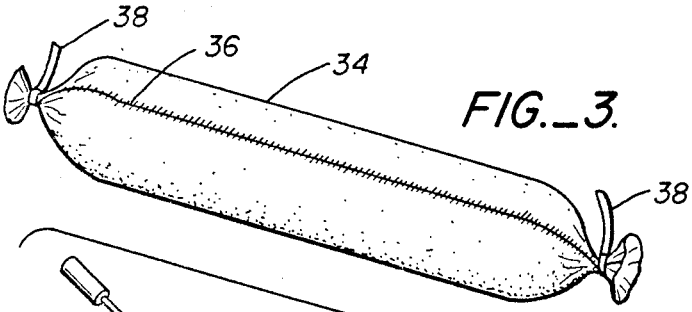
FIG. 3 is a perspective view of the container closed at both ends after the structural foaming agent has been placed therein.

As is shown in FIG. 2, the contents of receptical 30, having been thoroughly mixed, are then poured into a container 34. Container 34 is of a specific type, namely a bag or tube constructed of flexible material such as mylar or nylon. The material is water repellant and semi-porous and, preferably, the container or bag 34 includes seam 36 loosely stitched along the full length thereof along two sides. When filled, container 34 is closed at the lower end as by means of a metal or plastic tie 38. After the desired amount of foaming agent is poured into container 34, the other end thereof is also closed off by a tie 38 or by some other suitable means so the container has the appearance shown in FIG. 3.

Figure 4:
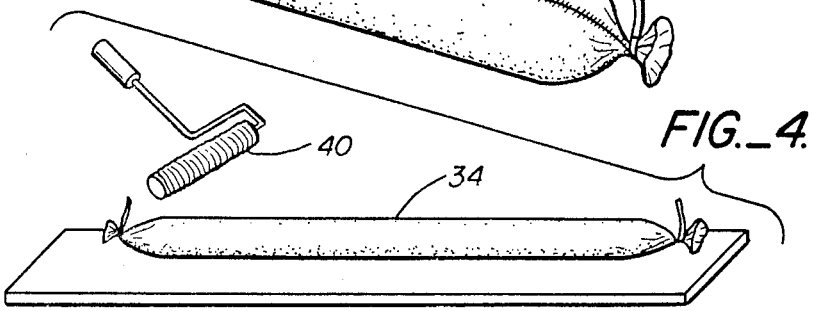
FIG. 4 illustrates the container of FIG. 3 being flattened prior to its placement in operative position between structural elements.

The operator now positions container 34 on a flat surface as shown in FIG. 4, preferably with the seams 36 being disposed at the top and bottom of the container. With a roller 40 or other suitable expedient, the operator levels out the contents within the container.

Figure 8:
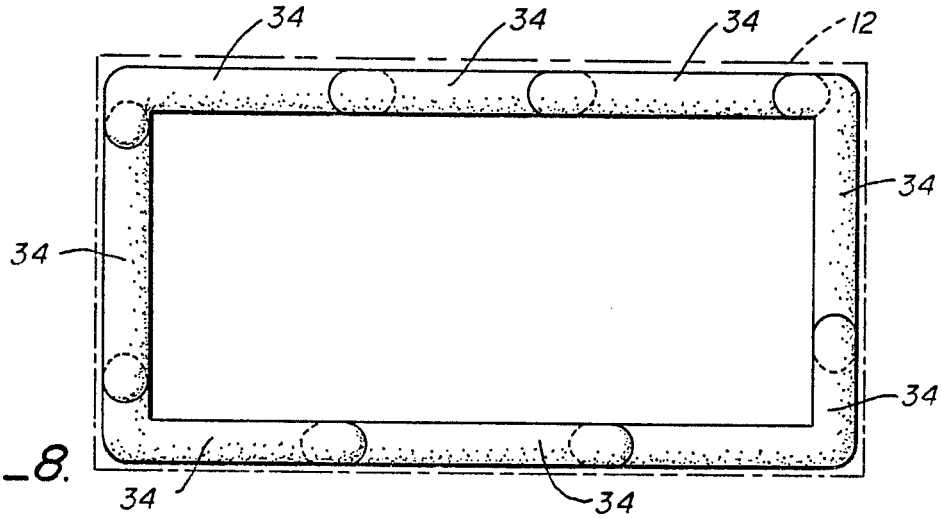
FIG. 8 is a plan view of structural components illustrating a plurality of containers positioned therebetween in partial overlapping fashion so as to form a fluid-tight seal.

The next step is to place the container 34 in the void space defined by structural elements 10 and 12. As can be seen in FIG. 5, the operator will normally position a plurality of such containers in the void space. In the FIG. 5 layout, a number of containers 34 are disposed in a single layer end-to-end about the periphery defined by the enclosure 10 and frame 12. If a water-tight seal is desired between the structural elements the containers 34 can be overlapped at their ends as shown in FIG. 8.

As perhaps best shown in FIGS. 6 and 7, the container or bag 34, when initially positioned in place, does not contact frame 12. Also, it should be noted that a seam 36 faces the frame while its companion underneath (not shown) is oriented toward enclosure 10.

Foaming of the contents of the container now takes place and the flexible material of the container allows two things to happen. First, the container distorts as pressure builds up inside due to foaming of the agent. As shown in FIG. 7, this distortion brings the upper container surface (in the position shown in broken line) into contact with frame 12. The following second action is equally important to the operation of the present system. Due to the openings formed in the surface of the container (which in this case are defined by the porosity of the material caused by loose weaving of the filaments thereof) a portion of the foaming agent migrates through the openings and is disposed externally of the container. A portion also migrates between the stitching forming seams 36 and is thus somewhat concentrated where the container contacts the enclosure and frame.

It will be appreciated that the two actions just described cooperate to create a bond between the container and both structural elements 10 and 12. That is, the portion of the foaming agent which has migrated through the openings is in direct engagement with both structural elements. The foaming agent thus foams one continuous body of foam between the structural elements 10 and 12.

The foam is now allowed to harden in place. Employing the "InsituFoam" product referred to above, it has been found that a load bearing cure can be effected within an hour or so. Because of this quick stabilization of the two structural elements it will not be necessary for the road crew or other workers employing the system to make a return trip days later to reopen the street or perform such other work as is normally necessary.

Figure 9:
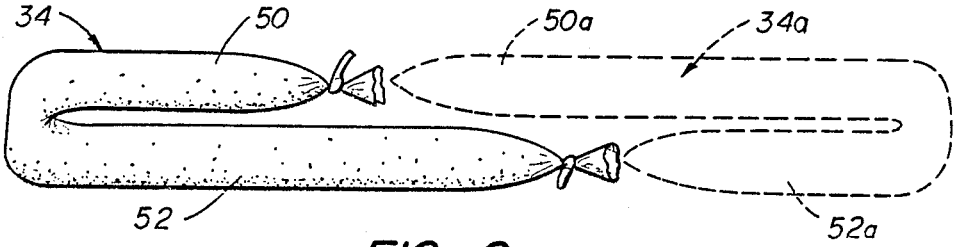
FIG. 9 illustrates two containers folded over and in partially overlapping relationship.

It will be appreciated that in some instances the void space existing between structural elements may be too great to allow stabilizing thereof by foam agent filled containers disposed in a single layer. The present system works just as well when more than one layer of bags is employed. The system, due to the migration of the agent portion through the containers, will bond the containers to each other as well as to the structural elements with which they are employed. The layering may be accomplished in any suitable fashion. FIG. 9 shows one approach to doing this wherein a double layer of containers is required to fill a void space. Referring to that Figure a first container 34 is folded over prior to placement thereof in a void space. The overlying segment 50 of container 34 is approximately half the size of the underlying segment 52. A second container **34*a* of like construction is then folded as shown in the broken lines in FIG. 9 so that the upper segment 50*a* thereof partially extends over segment 52. The lower segment 52*a* of container 34*a* is in end to end relationship with segment 52**. Of course, other suitable stacking schemes for establishing multi-layers of containers may be employed as long as an integral bond and connection is maintained between the structural elements and the foaming agent of the stacked containers.

What is claimed is:

1. A method of stabilizing a first structural element relative to a second structural element, said structural elements defining a void space therebetween, said method comprising the steps of:

positioning in said void space at least one flexible container defining a plurality of openings and containing a structural foaming agent;

foaming said agent within said container while said container is positioned in the void space to expand said agent within said container;

during said foaming step, changing the shape of said container due to pressure exerted by expansion of said agent;

during said foaming step, migrating a portion of said agent through the plurality of openings whereby said portion is disposed externally of said container;

engaging at least one of said structural elements with said agent portion;

creating a bond between said agent portion and said at least one structural element after the engaging step; and hardening said agent after foaming thereof within said void space.

2. The method of claim 1 wherein said hardening step and said bond creating step are carried out substantially simultaneously.

3. The method of claim 1 wherein said container is constructed of flexible material woven to define at least some of said plurality of openings, said migrating step comprising extruding said agent through said openings.

4. The method of claim 1 wherein said container is stitched along at least one side thereof to form a seam defining at least some of said plurality of openings, said migrating step comprising extruding said agent through said seam.

5. The method of claim 4 further comprising the step of orienting said container so that said seam faces one of said structural elements.

6. The method of claim 1 wherein said positioning step comprises placing a plurality of flexible containers containing a structural foaming agent in said void space.

7. The method of claim 6 including the step of at least partially overlapping said flexible containers when said flexible containers are positioned in said void space.

8. The method of claim 7 wherein said flexible containers are elongated, said partial overlapping of said flexible containers including the step of folding at least some of said containers to form superposed flexible container segments.

9. The method of claim 1, just prior to positioning said container in said void space, the further steps of mixing said agent, inserting said agent into said container, and closing said container.

10. The method of claim 9 including the additional step of leveling said agent after insertion of said agent into said container by applying externally applied forces to said container.

11. The method of claim 1 wherein said structural elements are an underground enclosure and a frame, said method including, prior to said positioning step, the step of disposing at least one spacer between said underground enclosure and said frame to create said void space.

12. The method of claim 7 including the additional step of bonding said overlapped containers together with agent portions migrated through openings in said overlapped containers.

13. In combination:

a first load bearing structural element;

a second load bearing structural element positioned above said first load bearing structural element; and at least one container positioned between said load bearing structural elements, said container containing a structural foaming agent foamed and hardened in situ and adapted to transfer a load applied to said second load bearing structural element to said first load bearing structural element, a portion of said structural foaming agent being disposed externally of said container, integral with the agent contained by said container, and forming a bond between at least one of said structural elements and said container.

14. The combination of claim 13 wherein said container is constructed of flexible material having a plurality of openings formed therein, said container being at least partially filled by said hardened structural foaming agent and said structural foaming agent portion comprising structural foaming agent which has migrated from the interior of the container to the exterior thereof through said openings prior to hardening of said structural foaming agent.

15. The combination of claim 13 wherein said first load bearing structural element comprises an underground enclosure and wherein said second load bearing structural element comprises a frame spaced from said underground enclosure.

16. The combination of claim 13 wherein a plurality of containers containing structural foaming agent hardened in situ are positioned between said load bearing structural elements.

17. The combination of claim 10 wherein at least some of said containers are in engagement and bonded together by structural foaming agent disposed externally of said container.

18. The combination of claim 17 wherein at least some of said containers include segments overlapping with segments of other of said containers.

19. A method of stabilizing a first structural element relative to a second structural element defining a void space therebetween, said method comprising the steps of:

inserting a structural foaming agent into a flexible container;

after said insertion step, positioning said flexible container into the void space between said structural elements;

after said positioning step, foaming said agent within said flexible container and creating an internal pressure within said flexible container with said foaming agent;

during said foaming step, utilizing said pressure to change the shape of said container and force a portion of said agent from the interior of said container to the exterior thereof and into contact with at least one of said structural elements;

creating a bond between said agent portion and said at least one structural element after contact therebetween while hardening said agent; and maintaining said bond after said agent hardens.

* * * * *

UNITED STATES PATENT AND TRADEMARK OFFICE

CERTIFICATE OF CORRECTION

PATENT NO. : 4,773,792

DATED : September 27, 1988

INVENTOR(S) : Phillip G. Landers

It is certified that error appears in the above-identified patent and that said Letters Patent are hereby corrected as shown below:

Column 6, Line 23 delete "10" and insert --16--.

Signed and Sealed this

Twenty-first Day of March, 1989

*Attest:*

DONALD J. QUIGG

*Attesting Officer*

*Commissioner of Patents and Trademarks*